United States Patent [19]

Iwashita et al.

[11] Patent Number: 4,551,104

[45] Date of Patent: Nov. 5, 1985

[54] TILT LOCK MECHANISM FOR MARINE PROPULSION DEVICE

[75] Inventors: Takashi Iwashita; Shinya Atsumi, both of Hamakita; Ryoji Nakahama, Iwata, all of Japan

[73] Assignee: Sanshin Kogyo Kabushiki Kaisha, Japan

[21] Appl. No.: 582,186

[22] Filed: Feb. 21, 1984

[30] Foreign Application Priority Data

Feb. 22, 1983 [JP] Japan ..... 58-26994

[51] Int. Cl.[4] ..... B63H 5/12

[52] U.S. Cl. ..... 440/56; 188/318; 440/61

[58] Field of Search ..... 440/55, 56, 61; 188/300, 314, 318; 267/64.12

[56] References Cited

U.S. PATENT DOCUMENTS

| | | | |
|---|---|---|---|
| Re. 27,932 | 2/1974 | Mettetal | 115/41 HT |
| 3,186,375 | 6/1965 | Cass | 115/41 |
| 3,285,221 | 11/1966 | North | 440/61 |
| 3,434,448 | 3/1969 | Woodfill | 440/61 |
| 3,434,450 | 3/1969 | McCormick | 115/41 |
| 3,722,455 | 3/1973 | Carpenter | 115/41 HT |
| 3,799,104 | 3/1974 | Kurling | 440/61 |
| 3,839,986 | 10/1974 | Meyer | 115/41 HT |
| 3,863,592 | 2/1975 | Borst | 115/41 HT |
| 3,885,517 | 5/1975 | Borst et al. | 92/13.51 |
| 3,888,203 | 6/1975 | Lohse | 115/41 HT |
| 3,983,835 | 10/1976 | Hall | 115/41 HT |
| 3,999,502 | 12/1976 | Mayer | 115/41 HT |
| 4,052,952 | 10/1977 | Hale | 115/41 HT |
| 4,064,824 | 12/1977 | Hall | 115/41 HT |
| 4,308,018 | 12/1981 | Nakamura | 440/61 |
| 4,363,629 | 12/1982 | Hall et al. | 440/55 |

*Primary Examiner*—Sherman D. Basinger
*Attorney, Agent, or Firm*—Ernest A. Beutler

[57] ABSTRACT

A tilt locking and shock absorbing arrangement for a marine outboard drive embodying a single cylinder and piston assembly for controlling the tilt and trim positions of the drive and for further absorbing shocks applied to it. An arrangement is provided whereby the trim position may be manually controlled without necessitating the operator's use of one hand to operate the mechanism when the desired position is reached. Popping up action is permitted in either normal or shallow water conditions but inadvertent popping up under shallow water, reverse drive is precluded.

8 Claims, 7 Drawing Figures

Fig-1
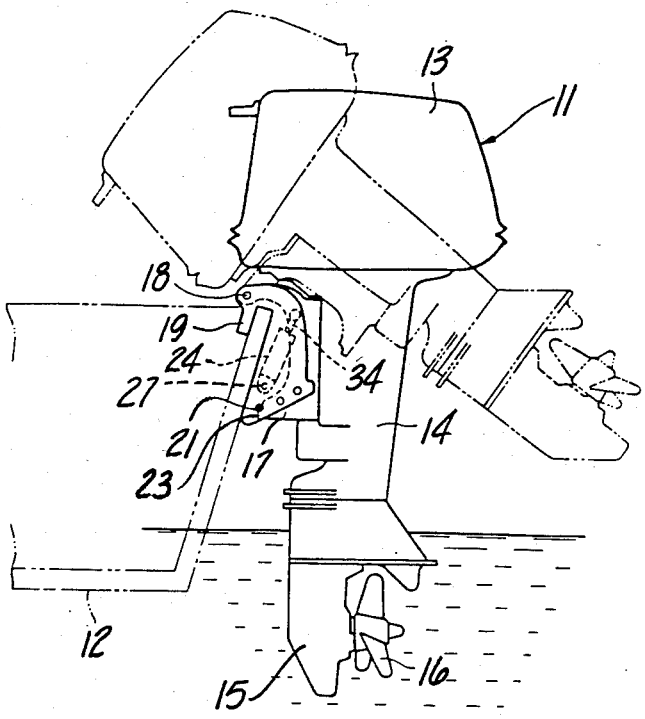
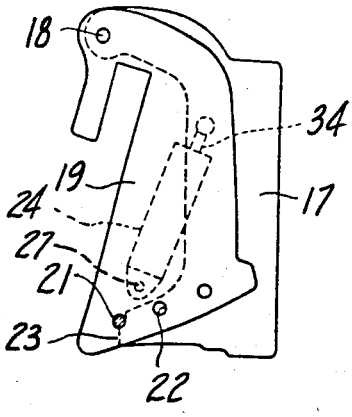
Fig-2

TILT LOCK MECHANISM FOR MARINE PROPULSION DEVICE

CROSS REFERENCE TO RELATED APPLICATION

This invention relates to an improvement in tilt locking mechanism for marine propulsion devices of the type illustrated and described in the copending application of that title, Ser. No. 565,271, filed Dec. 27, 1983 and assigned to the assignee of this application.

BACKGROUND OF THE INVENTION

This invention relates to a tilt locking mechanism for marine propulsion devices and more particularly to an improved, simplified tilt locking mechanism that permits the drive to be preset in a plurality of desired trim positions, which permits the drive to pop up under impact and return to position, which is simple to operate, has a minimum of controls and is effective to prevent undesired popping up of the drive under reverse operating conditions.

In the arrangement shown in the aforenoted copending application, a highly effective tilt locking mechanism is illustrated and described for controlling the position of a marine drive, for permitting its trim position to be easily adjusted and for permitting the motor to pop up when an underwater obstacle is encountered regardless of the trim position set. However, the arrangement shown in that application may permit the drive to pop up inadvertently when travelling rearwardly in a shallow water crusing condition. Thus, considerable care must be employed when operating in a reverse mode so as to prevent inadvertent popping up of the motor.

It is, therefore, a principal object of this invention to provide an improved construction of this type which will also prevent inadvertent popping up of the drive when travelling in reverse.

SUMMARY OF THE INVENTION

This invention is adapted to be embodied in a tilt locking and shock absorbing arrangement for a marine outboard drive that comprises a drive member that is supported for tilting movement relative to a hull of an associated watercraft about a substantially horizontally disposed tilt axis. A hydraulic assembly comprising a cylinder and a first piston slidably supported in the cylinder and defining first and second chambers is operatively interposed between the hull and the drive member for relative movement of the first piston and cylinder upon tilting movement of the drive member about the tilt axis. Damping means permits flow from the first chamber to the second chamber upon the application of a predetermined force tending to cause the drive member to tilt up about the tilt axis and for permitting flow from the second chamber to the first chamber upon the exertion of a predetermined force to effect tilt down of the drive member. A second piston is supported for movement in the cylinder within the second chamber and divides the second chamber into first and second parts. The position of the second piston is effective to control the normal trim position of the drive unit by restricting movement of the first piston relative to the cylinder in one direction. Passage means extend between the first chamber and the second part of the second chamber. First check valve means are provided in the passage means for permitting flow from the first chamber to the second part of the second chamber and for precluding flow from the second part of the second chamber to the first chamber. Second check valve means are also provided in the passage means for permitting flow from the second part of the second chamber to the first chamber and for precluding flow from the first chamber to the second part of the second chamber. In accordance with the invention, control means are provided for selectively opening one of the check valve means so that the other of the check valve means controls the flow through the passage means or for closing both of the check valve means for precluding any flow through the passage means.

BRIEF DESCRIPTION OF THE DRAWINGS

FIG. 1 is a side-elevational view of an outboard motor embodying a tilt lock mechaism constructed in accordance with the invention, attached to the transom of an associated watercraft (shown in phantom). The solid line view shows the motor in its normal running condition while the phantom line view shows the motor in a tilted up condition.

FIG. 2 is an enlarged side-elevational view of the tilt mechanism and associated tilt lock mechanism.

FIG. 3 shows the normal running condition.

FIG. 4 shows the popping up and return to the normal running condition from the popped up condition.

FIG. 5 shows operation in a shallow water condition.

FIG. 6 shows popping up from the shallow water condition.

FIG. 7 shows running in reverse in the shallow water condition.

DETAILED DESCRIPTION OF THE PREFERRED EMBODIMENT

Figure 3:
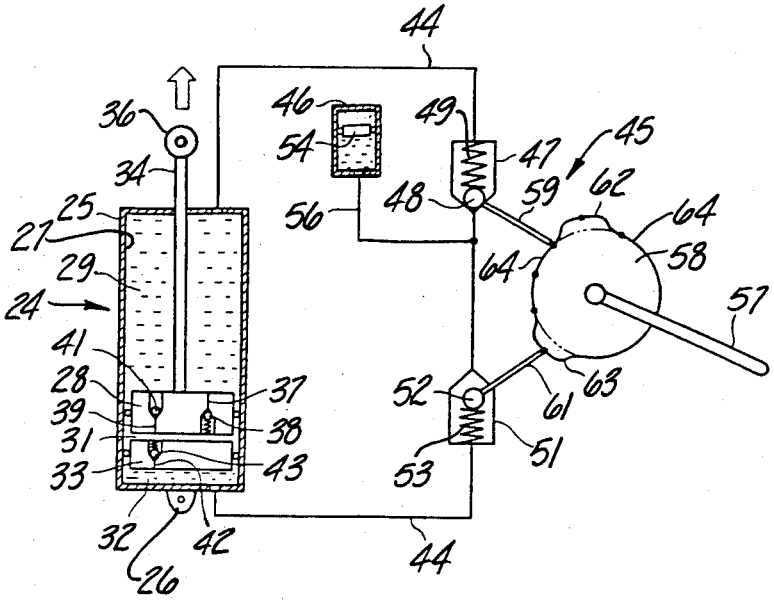
FIGS. 3 through 7 are cross-sectional, partially schematic views of the tilt locking mechanism under various conditions.

Referring first to FIGS. 1 and 2, an outboard motor is identified generally by the reference numeral 11. Except with respect to the tilt locking mechanism, the outboard motor 11 and its association with a watercraft, shown in phantom and identified by the reference numeral 12, is generally conventional. The outboard motor 11 includes a power head 13 in which an internal combustion engine of a known type is supported. The engine, which is not shown, has an output shaft that drives a drive shaft (not shown) that extends through and is journaled in a drive shaft housing 14 and which terminates at a forward, reverse transmission located in a lower unit 15. The transmission, in turn, drives a propeller 16.

The drive shaft housing 14 carries a steering shaft that is journaled for steering movement about a generally vertically extending axis by means of a swivel bracket 17. The swivel bracket 17 is, in turn, supported for pivotal movement about a generally horizontally extending axis by means of a pivot pin 18 which is, in turn, affixed to a clamping bracket 19. The clamping bracket is, in turn, affixed in a known manner to the hull of the watercraft 12.

A trim pin 21 is received in selective pairs of aligned apertures 22 formed in the clamping bracket 19. The swivel bracket 17 has a forwardly extending edge 23 that is adaptd to engage the trim pin 21 so as to determine the normal trim condition of the motor 11 about the pivot pin 18.

A combined tilt locking and shock absorbing assembly, indicated generally by the reference numeral 24 and shown in most detail in FIGS. 3 through 7, is incorporated for controlling the position of the motor 11, as will become apparent. Referring now to these additional figures, the mechanism 24 included a cylinder assembly 25 carrying an integral trunnion 26 at its lower end. The trunnion 26 affords a means by which a pivot pin 27 can pivotally connect the assembly 24 to the clamping bracket 19 in a suitable manner.

The cyclinder 25 has a cylinder bore 27 in which a first piston 28 is supported for reciprocation. The piston 28 divides the cylinder bore 27 into an upper chamber 29 and a lower chamber which is, in turn, divided into an upper portion 31 and a lower portion 32 by means of a floating piston 33 that is slidably supported in the bore 27. A piston rod 34 is affixed to the piston 28 and extends through the chamber 29. A suitable seal (not shown) surrounds the upper end of the piston rod 34 so as to prevent leakage of a hydraulic fluid that is contained within the chambers 29 and the lower chamber portions 31 and 32.

The exposed end of the piston rod 34 is formed with a clevis 36 to afford a connection to a pivot pin to provide a pivotal connection to the swivel bracket 17.

A first absorber passage 37 extends through the piston 28 so as to permit flow from the chamber 29 to the upper portion 31 of the lower chamber. A pressure-responsive one-way absorber valve 38 is provided in the passage 37 so as to permit flow from the chamber 29 to the lower portion 31 while precluding flow in the opposite direction.

A relief passage 39 also extends through the piston 28 so as to communicate the chamber 29 with the lower chamber upper portion 31. A check valve 41 is provided in the passage 39 so as to permit flow from the lower portion 31 to the chamber 29 while precluding reverse flow. The valve 41 opens at a significantly lower pressure than the valve 38. The weight of the motor 11 is sufficient so as to cause the valve 41 to open, as will become apparent.

A passage 42 extends through the piston 33 between the lower chamber parts 31 and 32. A pressure-responsive check valve 43 is positioned in this passage so as to permit flow only from the part 32 to the part 31 while precluding any reverse flow.

A bypass passage 44 extends from the upper portion of the upper chamber 29 to a position at the lower end of the lower chamber part 32. A manually operated control valve assembly, indicated generally by the reference numeral 45, is provided so as to control the flow through the passage 44 so as to permit manual adjustment in the angle of the outboard motor 11 relative to the clamping bracket 19 about the pivot pin 18. In addition, an accumulator chamber, indicated generally by the reerence numeral 46, communicates with the passageway 44 in a manner to be described so as to compensate for changes in the volume of the fluid in the chamber 29 displaced by the piston rod 34 without causing gases to enter into the assembly 24.

The manually operated control valve assembly 45 includes a first check valve 47 having a ball type valve element 48 that is urged by a spring 49 to a closed position that precludes communication from the chamber 29 to the lower chamber part 32. However, upon the exertion of sufficient pressure difference, the ball valve 48 can open so as to permit flow from the lower chamber part 32 to the chamber 29, as will become apparent.

The control valve assembly 45 includes a second check valve assembly 51 having a ball type check valve 52 that is urged by a coil compression spring 53 toward a closed position wherein flow between the chamber 29 and lower chamber part 32 is precluded. Fluid pressure can unseat the ball 52 under certain circumstances, as will be described, so as to permit flow from the chamber 29 into the lower chamber part 32.

The accumulator 46 includes a floating piston 54 that is pressurized on its upper side by an inert gas such as nitrogen. The underside of the piston 54 is urged against the hydraulic fluid which fills the chamber 29 and chamber parts 32 and 33. This hydraulic fluid may communicate from the accumulator 46 with the area in the passage 44 between the two check valve assemblies 47 and 51 through a passageway 56.

The valve assembly 45 also includes a manual operator having a manually operable lever 57 that operates a cam 58 which, in turn, operates a pair of push rods 59 and 61 by means of respective cam lobes 62 and 63 so as to selectively hold the respective balls 48, 52 of the check valve assemblies 47 and 51 in their opened positions. In addition, the cam 58 has an unlobed portion 64 which will cooperate with the push rods 59 and 61 so that both balls 48 and 52 will be held in their closed positions.

Figure 4:
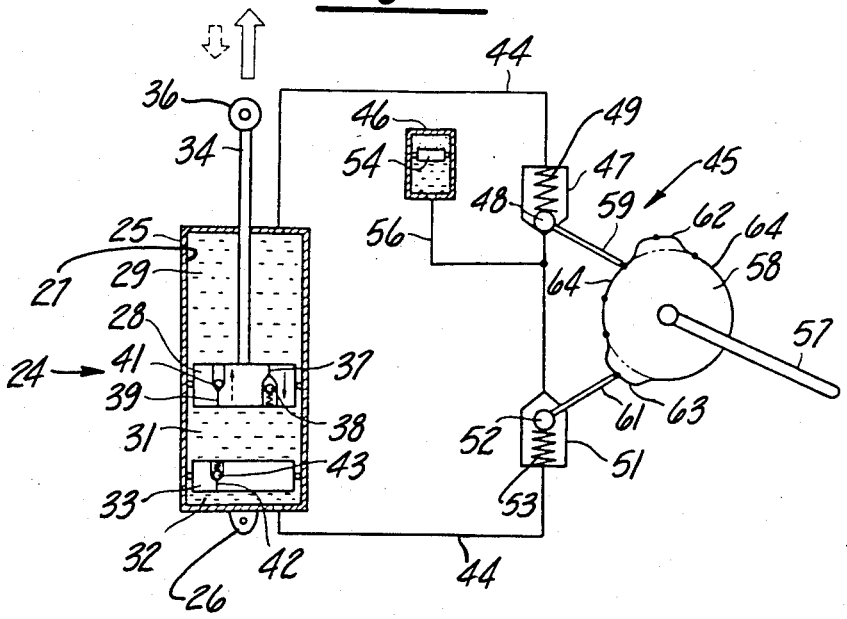

FIGS. 3 and 4 show the valve assembly 45 as it appears when set manually for normal running condition. In this condition, the lever 57 is positioned so that the push rod 59 will permit the ball 48 of the check valve 47 to be retained in its closed position by the spring 49. On the other hand, the push rod 61 will engage the ball 52 of the check valve 51 so as to hold the check valve 51 in an opened condition. Thus, the check valve 47 controls the direction of flow and the flow conditions through the passage 44.

The position of the floating piston 33 will determine the at rest position of the piston 28 and, accordingly, the trim angle of the motor 11 about the pivot pin 18. The valve 43 in the floating piston 33 has sufficient force required to open it so as to resist the weight of the motor 11 and hold it in the adjusted trim condition.

When operating in the reverse mode, the motor 11 tends to tilt up about the pivot pin 18. This movement causes a force to be exerted on the piston rod 34 which tends to cause it and the piston 28 to be drawn upwardly (FIG. 3). However, the setting of the absorber valve 38 is such that these normal reverse thrust forces are resisted and the motor 11 will be held against popping up under reverse drive condition.

When operating in a forward direction and if an underwater obstacle in struck by the lower unit 15 with sufficient force, the piston rod 34 will exert sufficient force on the piston 28 so as to overcome the action of the absorber valve 38 and permit the piston 28 to move upwardly and the motor 11 to pop up (FIG. 4). The absorber valve 38 will, however, offer some resistance to this movement. Fluid cannot flow from the chamber 29 through the passage 44 since the increase in pressure in the chamber 29 will hold the check valve assembly 47 and, more particularly, its ball 48 in the closed position. When the struck underwater obstacle provides sufficient force, the piston 28 will move upwardly and fluid will flow through the absorber valve 38 from the chamber 29 to the lower chamber part 31 above the floating piston 33. Because less of the piston rod 34 is immersed in the chamber 29, it will be necessary to add further fluid to the area below the piston 28 so as to accommodate for these volume changes. This fluid will be supplied from the accumulator 44 through the passage 58 and open check valve 51 to the area beneath the floating piston 33. Thus, the floating piston 33 will also move up slightly when the motor 11 pops up as shown in FIG. 4.

Once the underwater obstacle has been cleared, the weight of the motor 11 acting on the piston rod 34 and piston 28 will cause the return valve 41 to open and permit hydraulic fluid to flow back to the chamber 29 from the lower chamber part 31 through the return passage 39. As the motor lowers, as shown in the broken arrow in FIG. 4, the floating piston 25 will again move downwardly so as to displace fluid back to the accumulator 46 through the open check valve 51 so as to again comensate for the variation in volume displaced in the chamber 29 by the piston rod 34. Once the motor reaches the preset trim position, the downward movement will discontinue. During the downward movement, there is insufficient pressure generated on the underside of the floating piston 33 so as to cause the check valve 47 to open. Hence, no fluid will be returned to the chamber 29 through the passageway 44.

Figure 5:
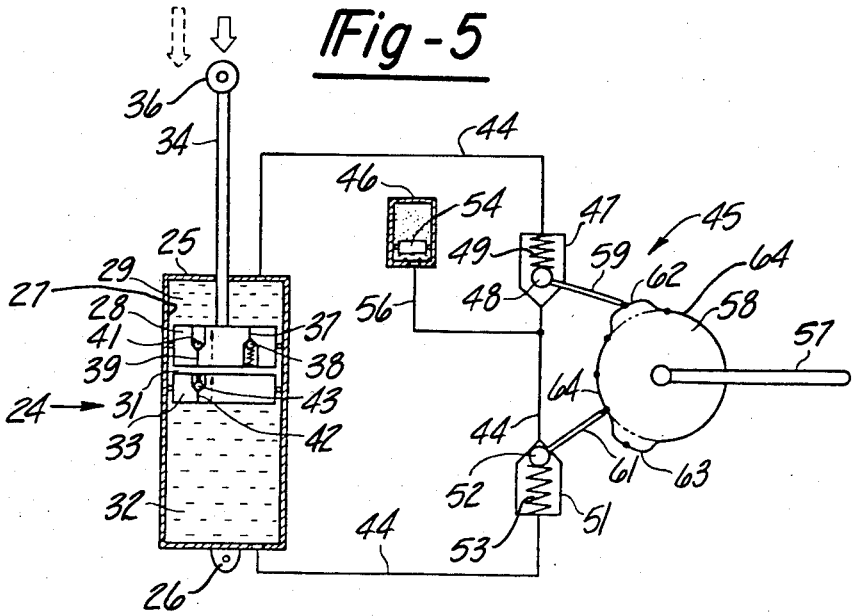
Figure 6:
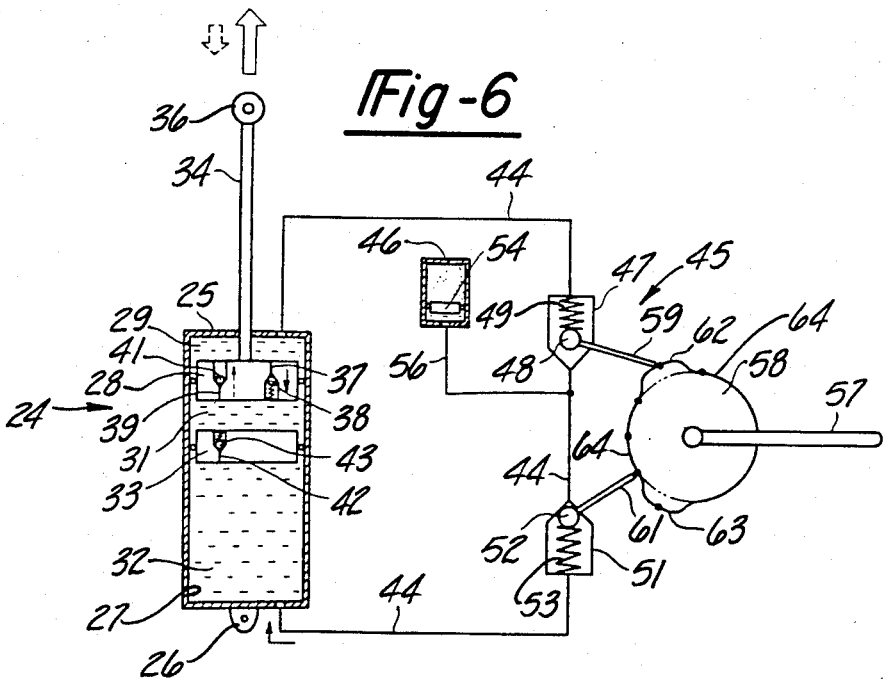

It it is desired to manually change the trim position of the motor 11 so as to either set the motor 11 for a shallow water running condtion or so as to tilt it up out of the water, the manually operated valve 45 is moved from its normal position, as shown in FIGS. 3 and 4, to its trim adjusting position, as shown in FIGS. 5 and 6. This causes the ball 48 of the check valve assembly 47 to be unseated and, at the same time, permit seating of the ball 52 of the check valve assembly 51. In this condition, fluid may flow between the chamber 29 and the lower part 32 through the passageway 44 under the control of the check valve assembly 51. That is, fluid may flow from the chamber 29 to the lower chamber part 32 if sufficient force is exerted so as to unseat the ball 52 of the check valve assembly 51. Flow in the opposite direction is, however, prevented.

When the manually operated valve 45 is set in the trim adjusting position, the trim of the motor 11 may be adjusted by the operator exerting a force on the motor 11 tending to rotate it in a counterclockwise direction about the pivot pin 18. This causes the piston rod 34 and piston 28 to move upwardly in the cylinder bore 27. Upon such upward movement, the fluid from the chamber 29 will be urged into the line 44 and will act upon the check valve 51 so as to unseat the ball 52 and permit the fluid to flow to the lower chamber part 32. This flow of fluid causes the floating piston 33 to follow the piston 28 in an upward direction until the desired trim angle is reached. The accumulator 46 will again cause fluid to enter the system so as to compensate for changes in volume displaced by the piston rod 34 in the chamber 29. When the desired trim position is reached, the operator need merely reduce or release the force he has applied on the motor 11. Thus, a downward force will be exerted upon the piston rod 34 which tends to cause the piston 28 to move downwardly in the bore 27. The piston 28 will, however, engage the piston 33 and any force tending to cause it to move downwardly will be resisted by the pressure necessitated to open the check valve 43 in the piston 33. This is greater than the force of the weight of the motor and, accordingly, the motor will be held in the tilted up condition.

Assuming that the motor has not been tilted up out of the water, but has only been tilted to a shallow trim condition, the device 24 will function so as to permit the motor to pop up when an underwater obstacle is struck when traveling in a forward dirction. Since the operation under these modes is believed to be readily apparent, it will not be described again in detail. However, FIG. 6 does show the condition when the motor 11 has popped up. Under this condition, fluid will flow through the absorber valve 38 from the chamber 29 to the lower chamber part 31. Again the accumualtor 46 will act so as to compensate for changes in volume displaced by the piston rod 34 in the chamber 29. Fluid may also flow from the chamber 29 to the lower chamber part 32 through opening of the check valve if sufficient force is encountered. When the underwater obstacle is cleared, the motor 11 will again return to the trim adjusted position. However, it will be at a slightly higher level due to the displacement of fluid through the passage 44 to the underside of th floating piston 33. The floating piston 33 will be held in a slightly elevated position under this return condition.

It should be noted that all of this operation may be accomplished with the manually operated valve 45 still held in the trim adjusted position. In this condition, if it is desired to tilt the motor back down to a lower trim adjusting condition, a very high forward thrust may be exerted by accelerating the motor 11. This high force, as indicated by the broken line arrow in FIG. 5, will cause the piston 28 to exert sufficient force on the piston 33 so as to cause the check valve 43 in the floating piston 33 to open and, accordingly, open the valve 41 in the piston 28 so that the pistons 28 and 31 can move downwardly together.

With the mechanism set in the condition shown in FIGS. 5 and 6, if the motor 11 is operated in the reverse mode and when in the shallow water condition, the check valve 51 will control primarily the resistance to popping up. The check valve 51 opens at a substantially lower pressure than the absorber valve 38 and, therefore, under shallow water reverse operation, great care must be taken to prevent popping up of the motor. In accordance with this invention, an arrangement is provided so as to facilitate reverse shallow water operation.

If the operator intends to operate in reverse with the motor 11 tilted up to a shallow water position, he can move the valve assembly 45 to a position wherein both of the check valve assemblies 47 and 58 will be closed. When this occurs, the absorber valve 38 alone controls popping up of the motor.

Figure 7:
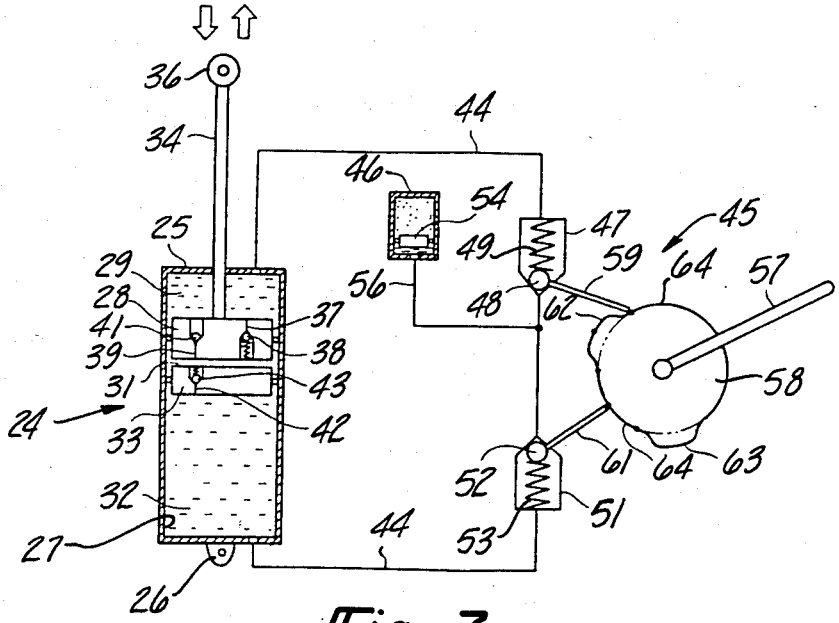

As shown in FIG. 7, to place the valve mechanism 45 in this shallow water, reverse mode operation, the lever 57 is rotated so that the push rods 59 and 61 will each cooperate with the unlobed portion 64 of the cam 58. Hence, both push rods 59 and 61 are retracted and the balls 48 and 52 of the respective check valves will be urged to their closed position by the springs 49 and 53. In this condition, no flow is permitted through the bypass passage 44.

Thus, when the valve 45 is in the position shown in FIG. 7, the absorber valve 38 will be effective to prevent popping up of the motor under reverse stress. In addition, the motor 11 will be retained in its up position by the check valve 43 which further precludes downward movement of the second piston 33. Hence, it is very easy to operate the motor in reverse under shallow water conditions without fear of its popping up.

It should be readily apparent from the foregoing description that a relatively simple arrangement has been provided so that the trim condition of the motor can be adjusted without necessitating an operator using one hand to move the motor and another hand to operate the control lever 57 and so that the motor may easily be operated in a reverse mode, shallow water condition.

Although a preferred embodiment of the invention has been illustrated and described, it is believed to be readily apparent that various changes and modifications may be made, without departing from the spirit and scope of the invention as defined by the appended claims.

We claim:

1. In a tilt locking and shock absorbing arrangement for a marine outboard drive comprising a drive member supported for tilting movement relative to a hull of an associated watercraft about a substantially horizontally disposeed tilt axis, a hydraulic assembly comprising a cylinder and a first piston slidably supported in said cylinder and defining first and second chambers, means for operatively interposing said hydraulic assembly between said hull and said drive member for relative movement of said first piston and said cylinder upon tilting movement of said drive member about said tilt axis, damping means for permitting flow from said first chamber to said second chamber upon the application of a predetermined force tending to cause said drive member to tilt up about said tilt axis and for permitting flow said second chamber to said first chamber upon the exertion of a predetermined force to effect tilt down of said drive member, and a second piston supported for movement in said cylinder within said second chamber and dividing said chamber into first and second parts, the position of said second piston being effective to control the normal trim position of the drive unit by restricing the movement of said first piston relative to said cylinder in one direction, passage means extending between said first chamber and the second part of said second chamber, first check valve means in said passage means for permitting flow from said first chamber to said second part of said second chamber and for precluding flow from said second part of said second chamber to said first chamber, and second check valve means in said passage means for permitting flow from said second part of said second chamber to said first chamber and for precluding flow from said first chamber to said second part of said second chamber, the improvement comprising the portion of the passage means extending between the first and second check valve means being substantially unrestricted so that opening of either of the check valve means causes the pressure in said passage means portion to act directly on the other of said check valve means, and control means for selectively opening one of said check valve means so that the other of said check valve means control the flow through said passage means or for closing both of said check valve means for precluding any flow through said passage means.

2. In a tilt locking and shock absorbing arrangement as set forth in claim 1 wherein the control means includes a single manually operable means for selectively opening each of the check valve means or for retaining them in their closed position.

3. In a tilt locking and shock absorbing arrangement as set forth in claim 2 wherein the single manually operable means is operative to maintain a selected one of the check valve means in its opened position and for permitting normal check valve operation of the other of the check valve means.

4. In a tilt locking and shock absorbing arrangement as set forth in claim 1 wherein the control means is movable between a first position wherein one of the check valve means is held in an opened condition and the other of the check valve means is permitted to function normally, a second position wherein the other of the check valve means is held in an opened position and the one of the check valve means is operative to perform its normal check valve function, and a third position wherein both of the check valves are in their closed positions.

5. In a tilt locking and shock absorbing arrangement as set forth in claim 1 wherein there is a check valve passage extending through the second piston for permitting flow in one direction therethrough while precluding flow in the opposite direction.

6. In a tilt locking and shock absorbing arrangement as set forth in claim 1 wherein the damping means comprises a first passage including pressure responsive absorber valve means for permitting flow from said first chamber to the first part of the second chamber upon the application of a predetermined force tending to cause said drive member to tilt up about said tilt axis, and a second passage including pressure responsive relief valve means for permitting flow from said first part of said second chamber to said first chamber upon the exertion of a predetermined force to effect tilt down of said drive member.

7. In a tilt locking and shock absorbing arrangement as set forth in claim 6 wherein the control means includes a single manually operable means for selectively opening each of the check valve means or for retaining them in their closed positions.

8. In a tilt locking and shock absorbing arrangement as set forth in claim 7 wherein the control means is movable between a first position wherein one of the check valve means is held in an opened condition and the other of the check valve means is permitted to function normally, a second position wherein the other of the check valve means is held in an opened position and the one of the check valve means is operative to perform its normal check valve function, and a third position wherein each of the check valve means is closed.

* * * * *